United States Patent [19]

Sakamoto et al.

[11] 4,404,046

[45] Sep. 13, 1983

[54] METHOD OF MAKING PERMANENT MAGNET OF MN-AL-C ALLOY

[75] Inventors: Yoichi Sakamoto, Hirakata; Akihiko Ibata, Izumisano; Shigeru Kojima, Yawata; Tadao Ohtani, Ise, all of Japan

[73] Assignee: Matsushita Electric Industrial Co., Ltd., Japan

[21] Appl. No.: 231,625

[22] Filed: Feb. 5, 1981

[30] Foreign Application Priority Data

| | | | |
|---|---|---|---|
| Feb. 7, 1980 | [JP] | Japan | 55-14542 |
| Feb. 27, 1980 | [JP] | Japan | 55-23905 |
| Apr. 14, 1980 | [JP] | Japan | 55-49367 |

[51] Int. Cl.[3] ..... H01F 1/02

[52] U.S. Cl. ..... 148/101; 148/120; 148/31.57

[58] Field of Search ..... 148/101, 102, 103, 120, 148/31.57

[56] References Cited

U.S. PATENT DOCUMENTS

| | | | |
|---|---|---|---|
| 3,266,954 | 8/1966 | Hokkeling et al. | 148/31.57 |
| 3,944,445 | 3/1976 | Ohtani et al. | 148/120 |
| 4,023,991 | 5/1977 | Kubo et al. | 148/31.57 |
| 4,133,703 | 1/1979 | Kojima et al. | 148/101 |

OTHER PUBLICATIONS

*A Dictionary of Metallurgy*, A. D. Merriman, MacDonald and Evans Ltd., 1958, p. 97.

*Primary Examiner*—John P. Sheehan
*Attorney, Agent, or Firm*—Wenderoth, Lind & Ponack

[57] ABSTRACT

There is provided a method of producing a manganese-aluminum-carbon alloy magnet, including the steps of preparing a polycrystalline Mn-Al-C alloy magnet having a specified direction of easy magnetization and subjecting the magnet to compressive working in that direction at a temperature of 550° to 780° C., the degree of said compressive working being equivalent to a logarithmic strain of $\leqq -0.1$ and working in said step at least up to a logarithmic strain of $-0.1$ being free compression.

5 Claims, 10 Drawing Figures

FIG. 5
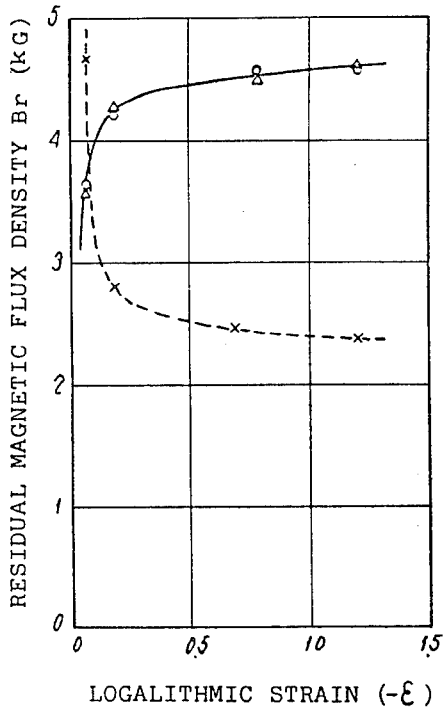
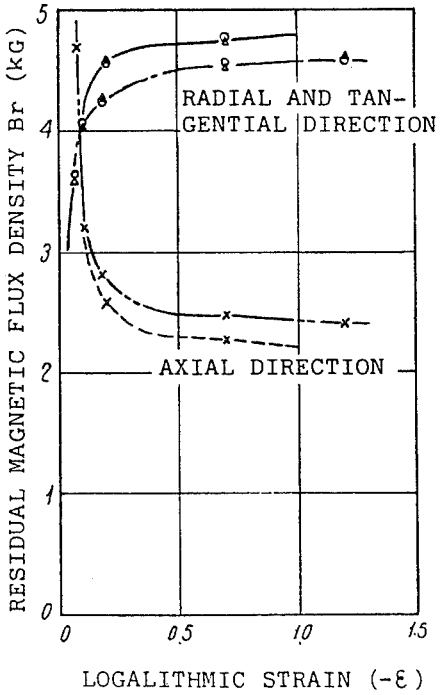
FIG. 6

METHOD OF MAKING PERMANENT MAGNET OF MN-AL-C ALLOY

BACKGROUND OF THE INVENTION

The present invention relates to a method of producing polycrystalline manganese-aluminum-carbon (Mn-Al-C) alloy magnets and, more particularly, to a method of producing Mn-Al-C alloy magnets suited for peripheral magnetization.

The Mn-Al-C alloy magnets are permanent magnets composed mainly of a face-centered tetragonal phase ($\tau$ phase, Llo type superstructure) which is ferromagnetic, and contain carbon as an essential component element. As magnets of this type, there are known ternary systems which do not contain any additive elements other than impurities and quaternary and higher systems containing small proportions of additive elements. The Mn-Al-C alloy magnets are available as isotropic magnets and also as anisotropic magnets having a specified direction of easy magnetization, depending on the distribution of the [001] axis of said face-centered tetragonal crystal which is the easy axis.

Generally, an anisotropic magnet has magnetic characteristics which are high only in a specified direction and exhibits its advantageous characteristics in unidirectional magnetization, i.e. in the field of bipolar magnetization. This field covers, for example, speaker magnets, motor bipolar rotor magnets and so on. However, the direction of magnetization is limited, so that in the field of peripheral multipolar magnetization, the anisotropic magnet has virtually given way to the isotropic magnet. As an anisotropic magnet used in the field of multipolar magnetization, there is known a magnet whose direction of easy magnetization extends radially in a uniform distribution from its center, but because its magnetic characteristics are low in the tangential direction, this type of magnet is not necessarily suited for multipolar magnetization applications and is rather disadvantageous particularly in high-density multipolar uses.

As methods of producing the Mn-Al-C alloy magnets, there are known a method comprising casting and heat-treatment and also a method further comprising warm plastic working process, e.g. warm extrusion. Especially the latter is known as a method of producing anisotropic permanent magnets which possess excellent characteristics such as high magnetic properties, superior mechanical strength, weather resistance and good machinability.

As a method of producing Mn-Al-C alloy magnets for peripheral magnetization other than isotropic magnets, there is known a method consisting of upsetting a cast and heat-treated alloy. It should, however, be understood that a mere upsetting does not help avoid the formation of dead zones, that it requires a comparatively high degree of working and that it might cause an uneven deformation.

SUMMARY OF THE INVENTION

It is an object of the present invention to provide method of producing Mn-Al-C alloy magnet for peripheral magnetization. A more specific object is to provide methods of producing the above magnets with a novel anisotropic structure having a plane of easy magnetization.

The production method according to the present invention is characterized in that it comprises the steps of preparing a polycrystalline Mn-Al-C alloy magnet body having a specified direction of easy magnetization and subjecting it to compressive working, e.g. upsetting, in said direction of easy magnetization at a temperature between 550° C. and 780° C., the degree of said compressive working being equivalent to a logarithmic strain of $\leqq -0.1$ and the compression at least up to said logarithmic strain of $-0.1$ in this step being free or unrestricted compression.

BRIEF DESCRIPTION OF THE DRAWINGS

FIG. 5 is a graph showing the change of residual magnetic flux density relative to the degree of compressive working in Example 1;

FIG. 6 is a graph showing the change of residual magnetic flux density relative to the degree of compressive working in Example 6;

DETAILED DESCRIPTION OF THE INVENTION

Figure 1:
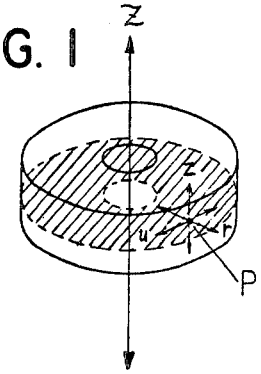
FIG. 1 is a perspective view showing an exemplary axially symmetric magnet article according to the present invention.

Against the foregoing technological background, we developed a novel permanent magnet which has directions of easy magnetization in a specified plane and exhibits very good magnetic characteristics in the plane. This magnet, being an anisotropic magnet in a broad sense of the term, has a new magnetically anisotropic structure which is almost unconceivable from the common knowledge of anisotropic magnets.

Irrespective of whether it is a crystallographically anisotropic product like a ferrite magnet or it is a shape-anisotropic material like an AlNiCo magnet, the usually-known anisotropic magnet is uniaxially anisotropic. Stated differently, it has high magnetic characteristics only in one direction at the cost of such characteristics in the plane perpendicular to said direction. Even the above-mentioned magnet having radially extending directions of easy magnetization has high magnetic characteristics only in radial directions and has just low magnetic characteristics in planes perpendicular to these directions, inclusive of the tangential direction.

On the other hand, the permanent magnet according to this invention has high magnetic characteristics in all directions within a specified two-dimensional plane at the cost of characteristics in the direction perpendicular to said plane. Thus, whereas it is magnetically anisotropic in three-dimensional terms, it is magnetically isotropic within said two-dimensional plane and can be regarded as the equivalent of an isotropic magnet, except that the magnetic characteristics thereof is by far superior to that of an isotropic magnet when it is used for peripheral magnetization. An ancillary advantage of the anisotropic permanent magnet according to the present invention is a reduced leakage flux in the direction perpendicular to the above-mentioned two-dimensional plane.

The permanent magnet according to the present invention is not different from the conventional Mn-Al-C alloy magnets in alloy composition and in the crystallographic structure of individual microcrystals. However, this new magnet exhibits a novel magnetic anisotropy as a polycrystalline body, due to its unique statistical distribution of said [001] axis. More particularly, magnet of the present invention is characterized in that $\tau$-phase microcrystals in its polycrystalline magnetic body have their [001] axes distributed in random directions parallel to a specified plane within the body and in preponderance as compared to the direction perpendicular to said plane.

Generally, the state of preferred orientation of crystals in a polycrystalline body is expressed in units of pole density P. Since the $\tau$-phase is tetragonal, the orientation of [001] axes may be envisaged as a distribution of (001) pole density. The (001) pole density in a given orientation of a polycrystalline body can be determined as the ratio of the integral intensity of (00n) plane diffraction as measured with the normal direction of X-ray diffraction coinciding with that orientation, to the corresponding intensity of a comparable isotropic body. In an isotropic magnet, its pole density is unity for all three-dimensional directions. The permanent magnet according to the present invention is such that $P>1$ in any directions parallel to a specified plane within the body, that in said particular plane, there is no large variation among different directions, and further that $P<1$ in the direction perpendicular to said plane. In the prototype permanent magnets manufactured by us in accordance with the present invention, the difference of (001) pole density between the direction in the specified plane and the direction perpendicular to that plane was found to be no less than 3 times for all the specimens. In addition, the variation of (001) pole density among the directions in the plane was not more than about 10%, which is generally within the accuracy tolerances of X-ray diffraction intensity measurements.

Magnetic articles for multipolar magnetization uses which are among the dominant applications of magnets according to the present invention are generally axially symmetric in shape as are permanent magnet rotors, for instance. FIG. 1 shows an exemplary axially symmetrical magnet article according to the present invention. In FIG. 1, the reference letter Z denotes the axis of symmetry and the hatching represents the plane perpendicular to Z including an optional point P in the article. In the case of an axially symmetrical magnet article such as the one illustrated in FIG. 1, the term 'specified plane' means the planes perpendicular to the axis of symmetry, which planes include both the radial (r in FIG. 1) and tangential (u) directions. At point P, z is axial and is parallel to Z. The central bore may be omitted for certain applications.

Figure 2:
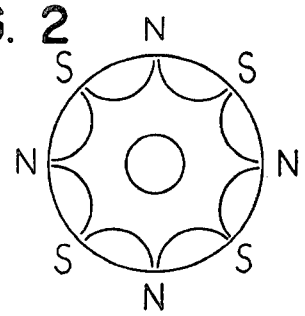
FIG. 2 is a schematic diagram showing the magnetic flux paths within the magnet body as formed on application of multipolar magnetization to the periphery of said magnet article.

FIG. 2 is a schematic diagram showing the magnetic flux paths formed within the magnet body of FIG. 1 as 8-pole magnetization is applied to the periphery. Within the above-mentioned specified plane, there have been formed magnetic flux paths extending radially in the vicinity of magnetic poles and tangentially at intermediate positions, thus making a good use of the advantageous characteristics of the magnet article such that the magnetic characteristics are high in all directions within the plane.

Another advantageous feature of the permanent magnet provided by the invention is that irrespective of the macroscopic position within the body of the article, this microscopic structure of $\tau$-phase is uniform throughout. For example, there is no region of coarse crystals at the central end portion due to the occurrence of a dead zone. This means that the article is homogeneous not only in magnetic characteristics but also in mechanical strength, machinability and so forth. Therefore the central bore as seen from FIG. 1 can be generated easily with a drilling machine.

Figure 3:
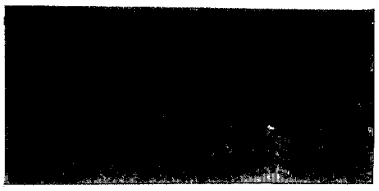
FIG. 3 is photograph showing a microscopic metallic structure of the magnetic article of FIG. 1 in a plane including the axis of symmetry.
Figure 4:
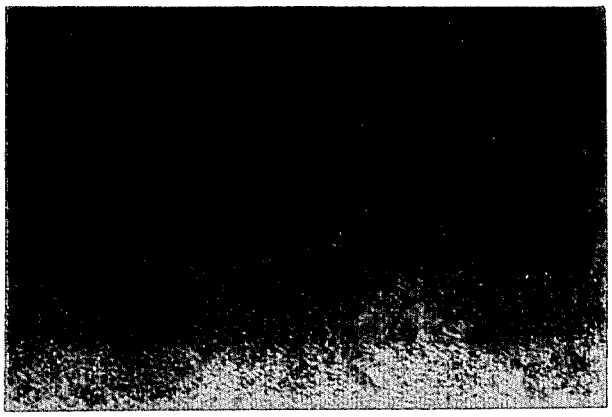
FIG. 4 is a microphotograph showing the same metallic structure.

One of the axially symmetric permanent magnets manufactured in accordance with the present invention was cut in a plane including the axis of symmetry, ground, etched and grossly observed for macroscopic structure. FIG. 3 is a photograph showing its metallic structure at a magnification of $\times 4$. It will be apparent from FIG. 3 that this magnet has a homogeneous metallic structure, being free from a coarse crystalline region due to occurrence of a dead zone. FIG. 4 is a metal-microphotograph showing the microscopic structure of the above magnet at a magnification of $\times 650$. In all positions within the view of FIG. 3, a structure identical with the microscopic structure of FIG. 4 is seen. As will be seen from FIG. 4, this microscopic structure is predominantly composed of microfine $\tau$-phase crystals smaller than about 1 $\mu$m.

The advantages of the permanent magnet according to the present invention, which as aforementioned, has a plane of easy magnetization, over the ordinary radially anisotropic magnet in actual applications will be described in detail hereinafter.

As a control permanent magnet having a radially anisotropic structure, a radially anisotropic strontium ferrite magnet manufactured by the conventional method was employed. The magnetic characteristics of this magnet, in radial direction, were Br=3.6 kG, Hc=2.6 kOe, (BH)max=2.8 MG.Oe and, in tangential direction, Br=1.4 kG, Hc=1.2 kOe, (BH)max=0.5 MG.Oe. The shape used for magnetization was of 24 mm in outer diameter, 12 mm in inside diameter and 15 mm in length. A 20-pole magnetization was applied to the periphery of the above cylindrical magnet article. This magnetization process was carried out by pulse magnetization at 1500 V, using a 2000 $\mu$F oil condenser. Measurement of the surface magnetic flux density of the periphery by a Hall device showed that the peak density values at the poles were 1.3 to 1.4 kG.

Then, among the permanent magnets manufactured in accordance with the present invention, one which was substantially comparable to the above conventional magnet in terms of magnetic characteristics in radial direction was selected, processed into the same cylindrical piece as above and magnetized around its periphery under the same conditions as described above. While the shape of the demagnetization curve of the present magnet was same-what different from that of said strontium ferrite magnet, magnetic flux density in the neighborhood of the working point on the demagnetization curve was not considered to be appreciably different from that of said strontium ferrite magnet. Thus, Br=4.2 kG, Hc=1.9 kOe, (BH)max=2.9 MG.Oe and these magnetic characteristics were uniform in all directions within the plane perpendicular to the axis of symmetry. Measurement of the surface magnetic flux density on its periphery in the same manner as above showed that the peak values at poles were 2.1 to 2.2 kG, thus substantiating the remarkable advantage of the anisotropic structure provided by the present invention. This magnet exhibited the difference about 3.5 times in the (001) pole density between the direction in the plane of easy magnetization and the direction perpendicular to that plane as measured by X-ray diffraction analysis.

The permanent magnet descirbed above can be manufactured by subjecting a uniaxially anisotropic polycrystalline Mn-Al-C alloy magnet body, which has been produced by a conventional technique such as warm extrusion, to free compressive working, e.g. upsetting, at an elevated temperature in the direction of anisotropy.

Thus, in the first place, a conventional alloy for Mn-Al-C magnets, e.g. an alloy consisting of 68 to 73 weight percent (hereafter, all percents are likewise by weight) of Mn, (1/10 Mn-6.6) to ($\frac{1}{3}$ Mn-22.2)% of C and the balance of Al, is processed into a uniaxially homogeneous microfine [001] fiber texture by a conventional technique such as warm extrusion and, then, this structure is subjected to compression in the axial direction. In other words, a macroscopic positive plastic strain is imparted to the material in a specified direction and, thereafter, a negative plastic strain is imparted in the same direction.

The degree of the above free compression must be at least −0.1 in terms of logarithmic strain. That figure is remarkably less than the free compressive strain required for the production of the known Mn-Al-C alloy magnet. Moreover, the necessary compressive load is about 20 to 40 percent less than that required in the conventional production process, assuming that other conditions are equal. In addition, a very high working speed and, hence, an increased productivity can be achieved in accordance with the present invention. The permanent magnet according to the present invention has a still additional advantage that it includes no coarse-crystalline region which would arise on occurrence of a dead zone, thus ensuring a high degree of homogeneity in mechanical strength and machinability.

When imparting a negative plastic strain, it is essential, for accomplishing the objects of the present invention, to ensure that the compressive working will be a process of free compression up to the equivalent of a logarithmic strain of −0.1. There is a known technology where compressive working is applied to a uniaxially anisotropic square-sectioned rod in the axial direction but in this art, a pair of lateral sides are restricted by mold walls from the start of compression and it is by no means a free compression. Moreover, the object of this prior art is a conversion of the direction of easy magnetization from one uniaxis to another uniaxis perpendicular thereto. This change of the direction of easy magnetization to a given direction by said prior art technique requires a working of over about 60 to 70% which is equivalent to a logarithmic strain of about −0.9 to −1.2.

In contrast, as will be more fully described in the examples, the present invention provides high magnetic characteristics in all directions perpendicular to the direction of compression with a compressive strain of $\leqq -0.1$. The term 'all directions' as used herein does not merely mean all radial directions but mean all directions in a two-dimensional plane including the tangential direction. This means that the resulting magnet is not uniaxially anisotropic. Moreover, because very desirable magnetic characteristics are achieved in the tangential direction within the magnet, the magnet is more suitable for peripheral multipolar magnetization than is the comparable radially anisotropic magnet.

Following the free compresssive working of $\leqq -0.1$ in terms of logarithmic strain, compressive working under a restriction on lateral sides may be applied according to the intended use. Such additional work includes, for example, molding in a confined mold for achieving a defined peripheral configuration and working under a partial or local constraint for reducing grinding work load for subsequent peripheral shaping.

The following examples are further illustrative of the present invention.

EXAMPLE 1

A rod-shaped billet, 40 mm in diameter and 30 mm long, was produced by melting and casting, in charge composition, 70% of Mn, 29.5% of Al of 0.5% of C. This billet was subjected to a heat-treatment in which it was held at 1100° C. for 2 hours, then cooled down with a draft of air to 500° C. and finally held at 600° C. for 20 minutes. Then, with the aid of a lubricant, the billet was extruded at 720° C. to a diameter of 15 mm. The extrusion ratio was 7.1 which was equivalent to a logarithmic strain of +2.0. The rod was cut to a length of 20 mm and after a lubricant was applied to both ends of the rod, the rod was subjected to free compressive working, i.e. upsetting, at 680° C. with a varying reduction radio. The working speed was equivalent to a means strain rate of 0.4 [$sec^{-1}$]. The term 'mean strain rate' means the absolute value of lagarithmic strain in the direction of axis of compression divided by the real working time. For example, the compressive working of 17% is equivalent to a logarithmic strain of −0.18 and actually this represents working at a speed of 7.3 $mm.sec^{-1}$.

From a portion near the periphery of the upset rod, a cube of about 6 mm was cut out in such a manner that edges of the cube would be parallel to the direction of axis of compression, radial direction and tangential direction, respectively, and the magnetic characteristics of the cube were measured. The change of residual magnetic flux density in relation to the reduction ratio is diagrammatically shown in FIG. 5, in which the abscissa represents logarithmic strain. The solid line shows values in the radial and tangential directions, and the dotted line shows the corresponding values in the axial direction. Whereas Br in radial and tangential directions prior to upsetting was as low as 2.6 kG, the value was remarkably increased on free upsetting. Thus, by even a slight degree of working, e.g. −0.18 in logarithmic strain, a high magnetic characteristic of 4.2 to 4.3 kG could be obtained. Moreover, detailed experimentation revealed that the high magnetic characteristic is attained not only in radial and tangential directions but also in all directions within the plane including the radial and tangential directions. This is a feature which is of great use for peripheral multipolar magnetization.

As will be seen from FIG. 5, the conversion of the direction of easy magnetization from axial direction to the plane including the radial and tangential directions progresses to a marked extent in the range up to the equivalent of a logarithmic strain of −0.1, and working to the equivalent of a logarithmic strain of −0.1 yielded a high Br value of about 4 kG in all directions within said plane.

EXAMPLE 2

A billet, 36 mm in diameter and 30 mm in length, was produced by melting and casting, in charge composition, 69.5% of Mn, 29.3% of Al, 0.5% of C and 0.7% of Ni. This billet was held at 1100° C. for 2 hours and, then, allowed to cool down to room temperature. Thereafter, with the aid of a lubricant, the billet was extruded at a temperature of 720° C. to a diameter of 20 mm. The extrusion ratio was 3.1 or the equivalent of a logarithmic strian of +1.1. The resulting rod was cut to a length of 22.5 mm and upset in a metal mold with an inside diameter of 30 mm. The working temperature was 680° C., the working speed was the equivalent of a mean strain rate of 0.08 [$sec^{-1}$], and both ends and lateral sides were lubricated. The final dimensions of this disc magnet were 30 mm in diameter and 10 mm long, and the final reduction ratio was equivalent to a logarithmic strain of −0.81.

From a portion near the periphery of this 30 mm-dia. magnet, a cube of about 6 mm was cut out in such a manner that edges of the cube would be parallel to the direction of axis of compression, radial direction and tangential direction, respectively, and the magnetic characteristics of the cube were measured. The magnetic characteristics were substantially uniform over the radial and tangential directions at Br=4.3 kG, Hc=2.2 kOe and (BH)max=3.2 MG.Oe, thus showing that this permanent magnet is suitable for peripheral magnetization.

The final stage of the working performed in this example was molding in which the lateral sides of the workpiece were subjected to a constraint but the first stage of working was a process of free compression, i.e. no lateral restriction was applied to the work up to a logarithmic strain of −0.7. Therefore, the whole process satisfied the free compression ratio (a logarithmic strain of $\leqq -0.1$) defined herein and provided the above-mentioned excellent magnetic characteristics. The lateral restriction applied to further working posterior to the free compression need not necessarily be an axially symmetric restriction like the one described above.

EXAMPLE 3

A billet, 40 mm in diameter and 40 mm in long, was produced by melting and casting, in charge composition, 69.4% of Mn, 29.3% of Al, 0.5% of C, 0.7% of Ni and 0.1% of Ti. This billet was held at 1100° C. for 2 hours and, then, cooled down with a draft of air to 500° C. Then, with the aid of a lubricant, the billet was extruded at 700° C. to a diameter of 15 mm. The extrusion ratio was 7.1 and the corresponding logarithmic strain was +2.0. The resulting rod was cut to a length of 25 mm and with a lubricant applied to both ends, it was subjected to free upsetting at 660° C. to a height of 15 mm. The logarithmic strain was −0.5. The working speed was about 0.3 [$sec^{-1}$] in terms of mean strain rate. From a portion near the periphery of the above magnet, a cube of about 6 mm was cut out in such a manner that edges of the cube would be parallel to the direction of axis of compression, radial direction and tangential direction and the magnetic characteristics of the cube were measured. The magnetic characteristics of the above product were substantially uniform in radial and tangential direction at Br=4.4 kG, Hc=2.6 kOe and (BH)max=3.7 MG.Oe.

EXAMPLE 4

Using the same material and procedure as Example 1, free upsetting up to a logarithmic strain of −1.2 was performed at a working temperature of 660° C. and a mean strain rate of 0.8 [$sec^{-1}$]. The magnetic characteristics of the test piece was measured under the same conditions as described in Example 1. These characteristics, in both radial and tangential directions were excellent at Br=4.7 kG, Hc=2.8 kOe and (BH)max=4.2 MG.Oe. This test piece was further heat-treated at 650° C. for 5 minutes and the magnetic characteristics of the product were measured in the same manner as Example 1. The results were Br=4.7 kG, Hc=3.0 kOe and (BH)max=4.4 MG.Oe.

EXAMPLE 5

A cylindrical billet, 40 mm in diameter and 40 mm long, was produced by melting and casting, in charge composition, 69.5 weight % of Mn, 29.3 weight % of Al, 0.5 weight % of C and 0.7 weight % of Ni in the atmosphere. This billet was held at 1100° C. for 2 hours, then cooled down with a draft of air to 500° C. and finally held at 600° C. for 20 minutes. Thereafter, with the aid of a lubricant, the heat-treated billet was extruded at a temperature of 720° C. to a diameter of 15 mm. The extrusion ratio was 7.1 and the corresponding logarithmic strain was +2.0. The resulting rod was cut to a length of 30 mm and with a lubricant applied to both ends of the rod, free upsetting was applied at a temperature of 700° C. up to a height of 7.5 mm. The logarithmic strain was −1.4. From a portion near the periphery of this magnet rod with a diameter of about 30 mm, a test piece measuring 6 mm×6 mm×6 mm was cut out for the measurement of magnetic characteristics. These characteristics, in radial and tangential direction, were Br=4.7 kG, Hc=2.9 kOe and (BH)max=4.3 MG.Oe. In axial direction, Br= 2.6 kG, Hc=2.0 kOe and (BH)max=1.4 MG.Oe. The remainder of the test material was analyzed by X-ray diffraction for (001) pole density difference as described hereinbefore. The result was about 9 times.

A magnet manufactured under the same conditions as above was machined to a hollow cylindrical shape, 24 mm in outside diameter, 12 mm in inside diameter and 7 mm long, and under the conditions described hereinbefore, 20-pole magnetization was applied to the periphery of the cylinder. The surface magnetic flux density peaks at poles around the periphery were within the range of 2.6 to 2.7 kG, thus showing that the product is a very desirable permanent magnet for multipolar magnetization.

The magnetic characteristics of the magnet can be further improved. This improved method will be described in detail hereinafter.

A conventional Mn-Al-C magnet alloy, for example an alloy consisting of 68 to 73 weight % of Mn, (1/10 Mn-6.6) to ($\frac{1}{3}$ Mn-22.2) % of C and the remainder of Al, is worked into a uniaxial homogeneous [001] fiber texture by a conventional technique such as extrusion at a temperature of 530° to 830° C. and, then, a compressive working is performed in a plurality of installments with the interposition of suspension (no plastic-deformation) periods. Stated differently, after a macroscopic positive plastic strain given in a predetermined direction, a series of negative plastic strains are sequentially given in the same direction. This compressive working requires at least a total degree of working equivalent to a logarithmic strain of −0.1.

When such sequential compressive working is thus applied with the interposition of a suspension period, Br tends to be higher, in all directions within planes perpendicular to the direction of compression, than when a continuous compressive working is carried out to the same total strain, and this tendency is more pronounced as the number of working installments is increased. This tendency is especially great when a compressive working equivalent to a logarithmic strain of ≦−0.1 is followed by another compressive working with the interposition of a suspension period therebetween. The Br value of the product is higher by about 0.2 kG than the magnet obtainable by continous compressive working to the same total strain.

The reason remains yet to be elucidated why Br becomes higher when serial working with suspension periods is carried out than in the case of continuous compressive working but it is conjectured that the deformation mechanism unique to a polycrystalline Mn-Al-C alloy and the recovery phenomenon, among others, are involved in the above result.

Thus, it appears that because the individual $\tau$-phase crystal grains undergo a "martensitic" reorientation characteristic of this alloy, and then after static recovery at the working temperature, they are further subjected to compression, the Br value of the magnet is increased. Since the alloy magnet according to the present invention is a polycrystalline body, the above-described effect begins to appear statistically even at a small amount of strain and then said reorientation proceeds with a large majority of crystal grains. The above-mentioned effect of static recovery is especially remarkable in the condition after the alloy undergoes a logarithmic strain of −0.1 where the change of the direction of easy magnetization has been substantially completed.

EXAMPLE 6

A cylindrical billet, 40 mm in diameter and 30 mm long, was produced by melting and casting, in charge composition, 70% of Mn, 29.5% of Al and 0.5% of C. This billet was held at 1100° C. for 2 hours, then cooled down with air to 500° C. and finally held at 600° C. for 20 minutes. Then, with the aid of a lubricant, the billet was extruded at 720° C. to a diameter of 15 mm. The resulting rod was cut to a length of 20 mm and again with the aid of a lubricant, free upsetting was applied at 680° C. The plastic working was now suspended and a free upsetting similar to the above was conducted again. The strain first given in the direction of axis of compression is represented by $\epsilon_1$, and the sum of $\epsilon_1$ and the value of strain caused by the second compressive working after a suspension period of 15 seconds is represented by $\epsilon_2$. As indicated in the following table, this experiment was carried out in 3 runs with varying total strain values.

| $\epsilon_1$ | $\epsilon_2$ |
|---|---|
| −0.05 | −0.1 |
| −0.1 | −0.2 |
| −0.2 | −0.7 |

The working speed was equivalent to a mean strain rate of 0.4 [sec$^{-1}$]. The means strain rate is as defined hereinbefore.

From a portion near the outer periphery of the upset piece, a cube of about 6 mm was cut out in such a manner that edges of the cube would be parallel to the axis of compression, radial direction and tangential direction, respectively, and the magnetic characteristics of the cube were measured. The changes of residual magnetic flux density (Br) relative to the degree of compression are shown in solid and broken lines. As a control, the same extruded rod as that described above was cut to a length of 20 mm and with the aid of a lubricant, continuous compressive working was carried out at a working temperature of 680° C. and a means strain rate of 0.4 [sec$^{-1}$] to the same final degree compression. The changes of Br in response to the degree of compression are shown in a dot-chain line and a double dot line in FIG. 6, where the abscissa represents logarithmic strain.

It is apparent from the graph that a higher Br value can be obtained by a series of compressions with the interposition of a suspension period than by continuous compressive working.

EXAMPLE 7

Figure 7:
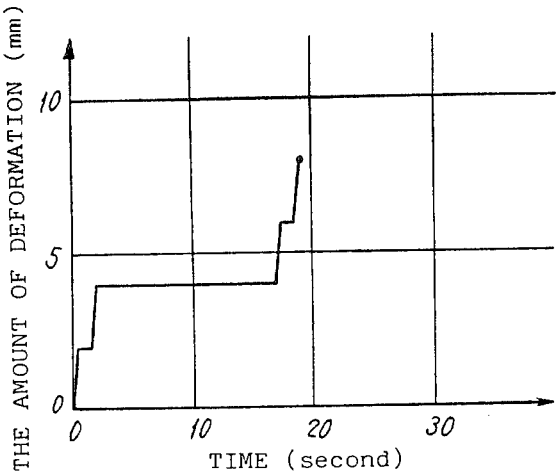
FIG. 7 is a diagram showing the relation of the amount of compressive deformation with time in Example 7.

A cylindrical billet, 40 mm in diameter and 40 mm long, was produced by casting and melting, in charge composition, 69.5% of Mn, 29.3% of Al, 0.5% of C and 0.7% of Ni. This billet was held at 1100° C. for 2 hours, and, then, allowed to cool down to room temperature. Then, with the aid of a lubricant, extrusion was carried out at a temperature of 720° C. until a finished diameter of 18 mm was reached. The extruded rod was cut to a length of 25 mm and, with the aid of a lubricant, free upsetting was carried out at a working temperature of 680° C. as shown in FIG. 7. In FIG. 7, the amount of deformation means the amount of decrement of the rod length.

From a portion near the periphery of this magnet, a cube of about 6 mm was cut out in such a manner that edges of the cube would be parallel to the axis of compression, radial direction and tangential direction, respectively, and the magnetic characteristics of the cube were measured. The magnetic characteristics were substantially uniform in radial and tangential directions at Br=4.7 kG, Hc=2.4 kOe and (BH)max=4.0 MG.Oe.

EXAMPLE 8

Figure 8:
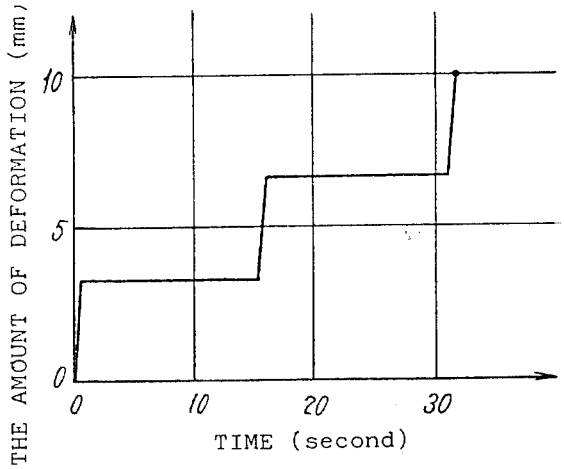
FIG. 8 is a diagram showing the relation of the amount of compressive deformation with time in Example 8.

The same extruded rod as that of Example 6 was cut to a length of 20 mm and with the aid of a lubricant, free upsetting was performed at a working temperature of 680° C. as shown in FIG. 8. From a portion near the periphery of this magnet, a cube of about 6 mm was cut out in such a manner that edges of the cube would be parallel to the axis of compression, radial direction and tangential direction, respectively, and magnetic measurements were made as described before. The magnetic characteristics were substantially uniform in radial and tangential directions at Br=4.8 kG, Hc=2.6 kOe and (BH)max=4.2 MG.Oe.

EXAMPLE 9

Figure 9:
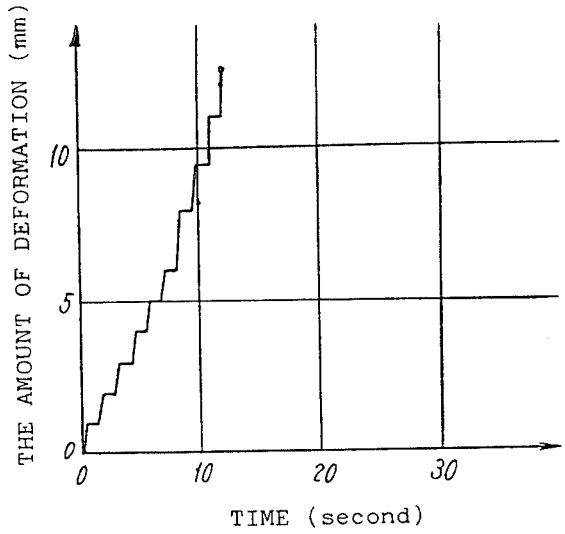
FIG. 9 is a diagram showing the relation of the amount of compressive deformation with time in Example 9.

A cylindrical billet, 40 mm in diameter and 40 mm long, was produced by melting and casting, in charge composition, 69.5% of Mn, 29.3% of Al, 0.5% of C, 0.7% of Ni and 0.1% of Ti. This billet was held at 1100° C. for 2 hours, then cooled down with air to 600° C. and held at this temperature for 30 minutes. Thereafter, with the aid of a lubricant, extrusion was carried out at a temperature of 720° C. to a final diameter of 18 mm. The extruded rod was cut to a length of 25 mm. Then, again with the aid of a lubricant, free upsetting was performed at 660° C. as shown in FIG. 9.

From a portion near the periphery of this magnet, a cube of about 6 mm was cut out in such a manner that edges of the cube would be parallel to the axis of compression, radial direction and tangential direction, respectively, and the magnetic characteristics of the cube were measured. The characteristics in radial and tangential directions were Br=4.7 kG, Hc=2.6 kOe and (BH)max=3.9 MG.Oe.

EXAMPLE 10

Figure 10:
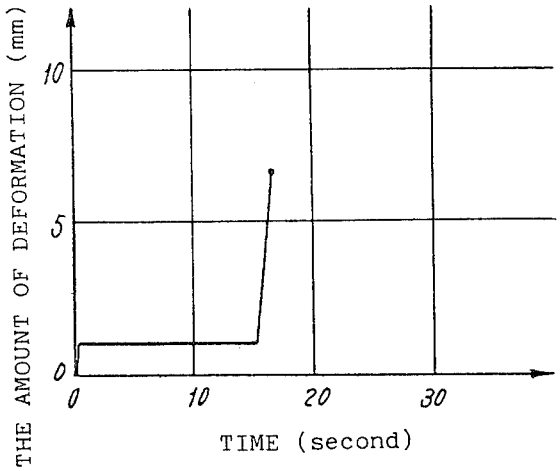
FIG. 10 is a diagram showing the relation of the amount of compressive deformation with time in Example 10.

The same extruded rod as that of Example 9 was cut to a length of 20 mm and with the aid of a lubricant, free upsetting was carried out at 660° C. as shown in FIG. 10. The magnetic characteristics in radial and tangential directions were Br=4.6 kG, Hc=2.4 kOe and (BH)max=3.7 MG.Oe.

In the above-mentioned production method, free compressive working was feasible in the temperature range of 550° C. to 830° C. but when working was performed at temover 780° C., the resultant magnetic characteristics were fairly low. More preferable range of such temperature was from 600° C. to 750° C.

Furthermore, the production method according to this invention is applicable to a broad range of working speeds, and working in a high speed range which is equivalent to a mean strain rate of 0.2 [$sec^{-1}$] results in especially high magnetic characteristics and is particularly useful when the degree of working is low.

What is claimed is:

1. A method of producing a polycrystalline permanent magnet, comprising the steps of preparing a polycrystalline Mn-Al-C alloy magnet having a specified direction of easy magnetization; and subjecting said magnet to compressive working in said direction at a temperature of 550° to 780° C., the degree of said compressive working being equivalent to a logarithmic strain of $\leqq -0.1$ and the working in said step, at least up to a logarithmic strain of $-0.1$, being free compression.

2. A method of producing a permanent magnet as claimed in claim 1 wherein said compressive working step consists of a stage of performing free compressive working at least up to a logarithmic strain of $-0.1$ and a stage of performing further compressive working under lateral restriction.

3. A method of producing a permanent magnet as claimed in claim 1 wherein said compression is performed in a working speed which is equivalent to a mean strain rate of $\geqq 0.2$ $sec^{-1}$.

4. A method of producing a permanent magnet as claimed in claim 1 wherein said compressive working step consists of a plurality of workings with the interposition of a suspension period, wherein said suspension period is interposed when the degree of said compressive working is equivalent to a logarithmic strain of $\leqq -0.1$.

5. A permanent magnet of Mn-Al-C alloy having a specified plane of easy magnetization, the alloy being magnetically isotropic in said specified plane and anisotropic in planes perpendicular to said specified plane, which is produced by a method comprising the steps of preparing a polycrystalline Mn-Al-C alloy magnet having a specified direction of easy magnetization; and subjecting said magnet to compressive working in said direction at a temperature of 550° C. to 780° C., the degree of said compressive working being equivalent to a logarithmic strain of $\leqq -0.1$ and the working in said step, at least up to a logarithmic strain of $-0.1$, being free compression.

* * * * *